United States Patent [19]

Uyeda

[11] Patent Number: 4,756,176

[45] Date of Patent: Jul. 12, 1988

[54] FENCE LEVER CONTROL DEVICE FOR A COMBINATION LOCK

[75] Inventor: Tim M. Uyeda, South San Gabriel, Calif.

[73] Assignee: La Gard, Inc., Torrance, Calif.

[21] Appl. No.: 873,811

[22] Filed: Jun. 13, 1986

Related U.S. Application Data

[63] Continuation of Ser. No. 676,628, Nov. 30, 1985, abandoned.

[51] Int. Cl.[4] ..... E05B 37/08

[52] U.S. Cl. ..... 70/303 A; 70/301; 70/321; 70/315

[58] Field of Search ..... 70/302, 303 A, 303 R, 70/316, 301, 321, 322, 315, 317, 318

[56] References Cited

U.S. PATENT DOCUMENTS

| | | | |
|---|---|---|---|
| 2,660,873 | 12/1953 | Bennett et al. | 70/303 A |
| 3,045,466 | 7/1962 | Herlong | 70/303 A |
| 3,176,486 | 4/1965 | Richardson | 70/303 A |
| 3,968,667 | 7/1976 | Gartner | 70/303 A |
| 3,991,596 | 11/1976 | Gartner | 70/303 A |
| 4,142,388 | 3/1979 | Phillips et al. | 70/316 |
| 4,257,249 | 3/1981 | Johns-Hunt | 70/303 A |
| 4,532,785 | 8/1985 | Uyeda | 70/303 R |

FOREIGN PATENT DOCUMENTS

| | | | |
|---|---|---|---|
| 159448 | 10/1954 | Australia | 70/303 A |
| 644382 | 7/1962 | Canada | 70/302 |

*Primary Examiner*—Robert L. Wolfe
*Assistant Examiner*—Suzanne L. Dino
*Attorney, Agent, or Firm*—Poms, Smith, Lande & Rose

[57] ABSTRACT

A fence lever control device for a combination lock provides a pivoted plate having an arm positioning a spring to normally bias the fence lever of the lock in a position out of engagement with the fence lever operating cam wheel, with an actuator roller mounted to the cam wheel which engages a follower surface on the pivoted plate once on each complete revolution of the cam wheel in a given direction in response to similar rotation of the dial shaft to which the cam wheel is mounted to thereby shift the pivoted plate and its associated spring mounting arm in an over center fashion to place the spring in a position to bias the fence lever toward the cam wheel, movement of the fence lever into engagement with the cam wheel being prevented by engagement between the fence member and the tumbler wheel assemblies when the wheel assemblies are not oriented in a predetermined relationship.

6 Claims, 2 Drawing Sheets

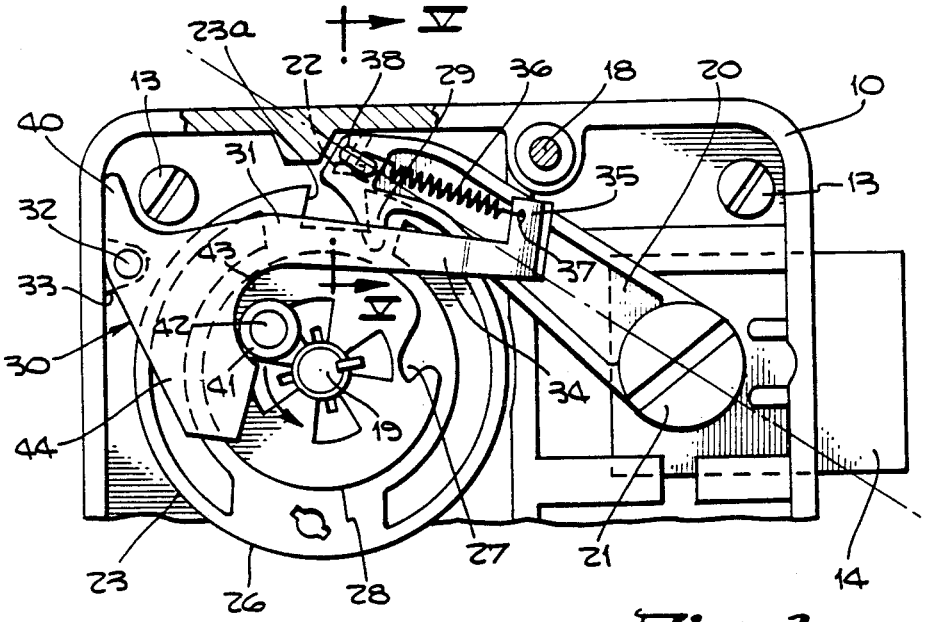
Fig. 3.
Fig. 4.
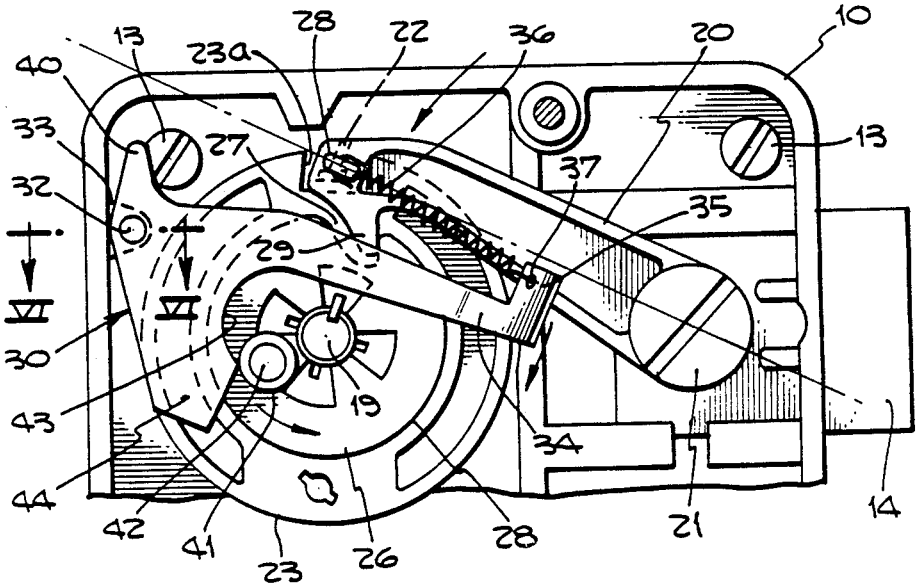

FENCE LEVER CONTROL DEVICE FOR A COMBINATION LOCK

This application is a continuation of Ser. No. 676,628, filed 11/30/85 and now abandoned.

BACKGROUND OF THE INVENTION

This invention relates in general to combination locks and in particular to an improved fence lever control device for normally maintaining the fence lever out of engagement with the cam wheel of the lock which is utilized for operating the lever to move the lock bolt between lock open and lock closed positions.

It is common in combination locks, such as that disclosed in the U.S. Pat. No. 4,142,388, for the nose portion of the combination lock fence lever to ride normally on the outer periphery of the cam wheel so that the fence member associated with the fence lever will not ride upon the tumbler wheels of the lock mechanism. Otherwise, an unauthorized, but lock manipulation skilled person, might endeavor to manipulate the lock mechanism and "feel" the engagement between the fence member and the wheel assembly gates to thereby determine the combination for the lock. However, it has also been found that the engagement between the nose portion of the fence lever and the gate of the cam wheel, by which the fence lever is engaged and operated to move the bolt to an open position by rotation of the cam member, can allow for an unauthorized lock manipulation skilled person to determine where the cam wheel gate is and then by manipulating the lock parts in a predetermined manner also bring the fence member in contact with edges of the gates of the wheel assemblies while the lever nose is positioned in the cam wheel gate.

In order to overcome the contact or "feel" of the fence lever with the rotating lock portions inclusive of the cam wheel and gate wheel assemblies, means have been developed heretofore such as in U.S. Pat. No. 3,991,596, for normally maintaining the fence lever in an inactive position out of engagement with the rotating lock parts. However, it is believed that these prior mechanisms have been fairly complicated in their assembly operations, are not easily added, or adapted to ease of assembly techniques, in mass production of combination locks and generally required some manipulation of the combination of the lock to release the lever in a manner which may or may not be always reliable to cause opening of the lock.

SUMMARY OF THE INVENTION

It is, therefore, the primary object of the present invention to disclose and provide a simple yet reliable and effective construction and mode of operation for a fence lever control device to normally hold the fence lever in an inoperative position and yet is operated with each revolution of the dial shaft without effecting other operating conditions or parts of the lock mechanism. It is a further object of the present invention to provide such a device that can be easily assembled to a combination lock during the assembly techniques and which requires relatively few parts operating in a simple and inexpensive manner to produce a reliable and repeating motion of the device which will not give an unauthorized lock manipulating person any "feel" for opening the lock through movement and/or engagement between the fence lever and the gate wheel assemblies and/or cam wheel.

Generally stated, the present invention in a fence lever control device for a combination lock includes the provision of means for normally keeping the nose of the fence lever spaced from the cam wheel, such means being so provided so as to move the fence lever and its associated nose toward the cam wheel in a predetermined manner correlated to, and operating in response to, rotation of the dial shaft in a predetermined manner whereby premature, lock manipulation type contact between the fence wheel nose and the cam wheel gate are prevented until such time as the tumbler wheel gates are aligned to one another and are ready to receive the fence member of the fence lever as part of the authorized opening of the lock by dialing a predetermined lock combination.

More specifically, the present invention in a fence lever control device includes the provision of a biasing means for normally biasing the lever to its inactive position and for once, during each revolution of the dial shaft in a given direction, biasing the lever toward the cam wheel and gate wheel assemblies during a portion only of such revolution. In a preferred exemplary embodiment of the present invention, such biasing means includes a spring connected at one end to the fence lever, an over center acting arm connected to a second end of the spring and mounted for shifting movement between an first position where the arm positions the spring to bias the fence lever away from the cam wheel and wheel assemblies and a second position wherein the arm positions the spring to bias the fence lever toward said assemblies and cam wheel, and actuator means driven by dial shaft rotation in a given direction for shifting the over center arm from its first position to its second position once during each shaft revolution in a given direction. On such shifting movement of the over center arm by the actuator means during each shaft revolution as stated, if the wheel assembly gates are aligned, the fence lever is allowed to move its nose into engagement with the cam wheel gate since the fence member of the fence lever will enter such wheel gates. However, if the combination has not been correctly entered and the gate wheel assemblies are not aligned to receive the fence member, the fence member will be held up by engagement with the outer peripheries of the wheel assemblies as the cam wheel gate passes beneath the nose of the fence lever and the spring connected between the fence lever and the over center arm will shift the over center arm away from its second position back into its first position.

It is believed that a more complete understanding of the improvement in the fence lever control device of the present invention will be afforded to those skilled in the art from a consideration of the following detailed description of a preferred exemplary embodiment thereof. Reference will be made to the appended sheets of drawings which will first be described briefly.

BRIEF DESCRIPTION OF THE DRAWINGS

FIG. 3 is a front view of the lock of FIG. 1 showing the preferred exemplary embodiment of fence lever control device holding the fence lever free of the cam wheel of the lock.

FIG. 4 is a front view of the lock of FIG. 1 showing the exemplary embodiment of fence lever control device moving the exemplary fence lever into engagement with the gate of the cam wheel.

DETAILED DESCRIPTION OF THE PREFERRED EXEMPLARY EMBODIMENT

Figure 1:
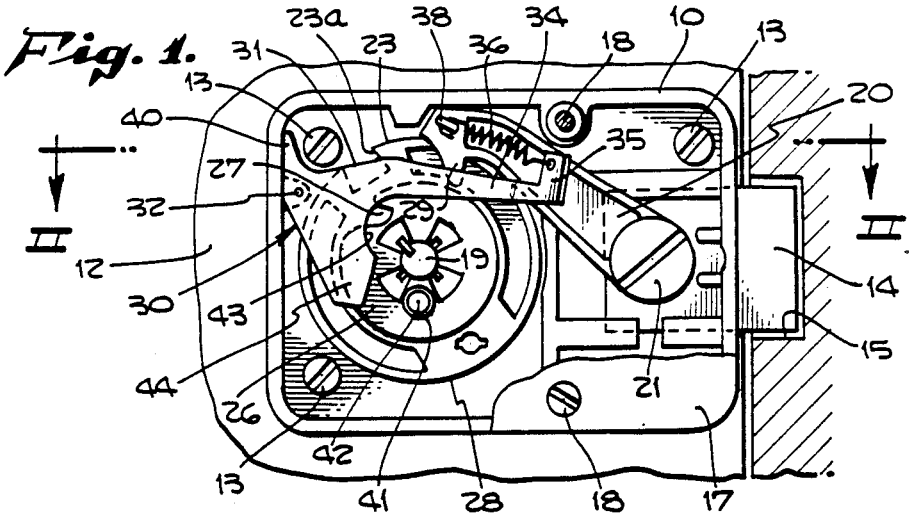
FIG. 1 is a front view, partially in section to remove the cover, of an exemplary combination lock having a preferred exemplary embodiment of fence lever control device in accordance with the present invention.
Figure 2:
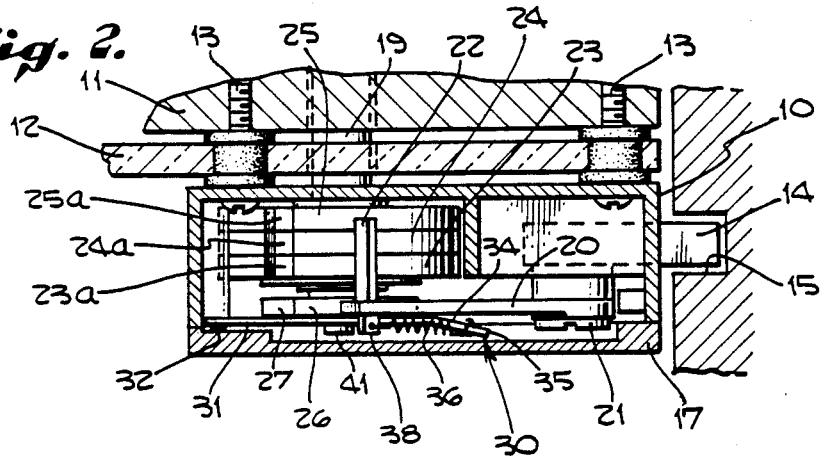
FIG. 2 is a section view of the lock of FIG. 1 taken therein along the plane II—II.

Referring initially to FIGS. 1 and 2, an exemplary embodiment of the combination lock is illustrated as an exemplary embodiment of lock mechanism in which the present invention in an improved control device for operating the fence lever is illustrated. The exemplary lock includes a housing 10 mounted on the interior of a safe door 11 with an interdisposed guard plate 12 by appropriate mounting screws 13 in known fashion. The guard plate and lock mounting means may be provided as in the disclosure of U.S. patent application Ser. No. 508,119 filed June 27, 1983 entitled "Protective Lock Mounting Plate For Safe Door Locks" or alternatively as disclosed in application for U.S. patent application Ser. No. 649,666 filed Sept. 12, 1984 entitled "Lock Protecting Device For High Security Safes.". The exemplary lock includes a bolt 14 which is adapted to be received within a receptacle 15 formed in the safe wall in conventional manner. The generally box configuration housing 10 is provided with a cover 17 which is held in place by mounting screws 18.

Exemplary of the types of combination locks in which the present improvement in a fence lever control device finds use are the locks illustrated in the prior U.S. Pat. No. 4,142,388 entitled "Tumbler Wheels For Combination Locks" and in the disclosure of application for U.S. Letters Patent Ser. No. 289,452 filed Aug. 3, 1981 entitled "Combination Lock", the disclosures of which are incorporated herein by reference. However, for purposes of the present disclosure, it is noted that locks of this general type employ a fence lever 20 which is pivotally mounted at one end by a pivot screw 21 secured to bolt 14 and have a fence 22 protruding laterally from an opposite free end which is adapted to cooperate in known manner with the gates 23*a*, 24*a* and 25*a*, respectively, of the exemplary gate wheel assemblies 23, 24 and 25. The gate wheel assemblies are generally formed with an inner drive ring manipulated by rotation of dial shaft 19 and have an outer relatively adjustable gate ring as more fully disclosed in said U.S. Pat. No. 4,142,388 and said application for U.S. patent application Ser. No. 289,452.

As is further customary in combination locks, a cam wheel 26 is provided on an inner end of the dial shaft 19 and is provided with a cam gate 27 to cooperate with a nose 29 formed on the lower portion of the free end of fence lever 20 as best seen in FIGS. 1, 3 and 4. When the fence lever nose 29 is in engagement with the cam gate 27, allowed only when the combination has been correctly dialed and the fence 22 is received in the tumbler wheel assembly gates aforedescribed, further manipulation of the dial shaft as by turning the dial in the correct direction will pull bolt 14 out of the safe wall receptable 15 to cause unlocking of the combination lock. It has been known heretofore that unauthorized entry into combination locks can be achieved by persons very skilled in the lock manipulation art by turning the lock dial and its associated shaft to hopefully bring portions of the tumbler wheels, and particularly their gates, in contact with the fence and thus it is common to have the fence lever nose 29 normally ride on the exterior surface or periphery 28 of cam wheel 26. However, it has also been found that persons skilled in the lock manipulation art can use even slight indications or "feel" imparted to the dial by the fence lever nose 29 engaging lateral extremities of the cam wheel gate 27 in a lock manipulation procedure. Attempts have, therefore, been made heretofore, as in U.S. Pat. No. 3,991,596 entitled "Tumbler Wheel, Changeable Combination T-Lock Construction" to maintain portions of the fence lever 20 free of the tumbler wheel assemblies and cam wheel until such time as the correct combination is dialed for the lock. In the disclosure of Patent '596, the pivoted fence lever is normally held out of engagement with the tumbler wheel assemblies and cam wheel by a releasable latch mechanism in an inactive position. As a part of correctly operating the combination lock with the authorized combination, associated cam members and spring devices are operated to impact upon the fence lever and throw it toward the tumbler wheel assemblies. As stated hereinbefore, it is a primary object of the present invention to disclose a more simplified, inexpensive and independently operating device for controlling movement of the fence lever which is not dependent upon other portions of the lock mechanism or the dialing of the correct combination.

Figure 5:
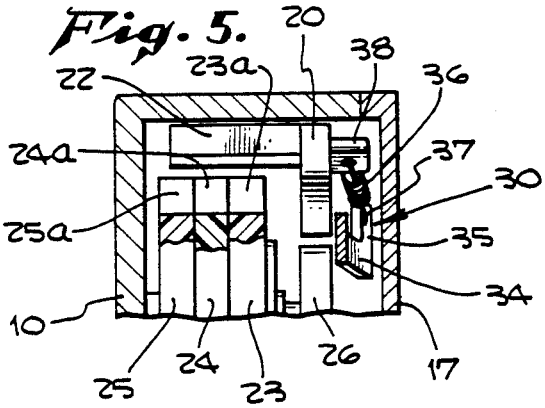
FIG. 5 is a partial section view of the lock of FIG. 3 taken therein along the plane V—V.
Figure 6:
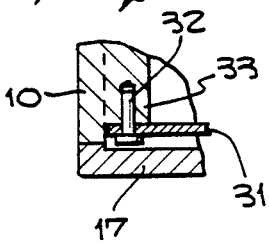
FIG. 6 is a detail section view of a portion of the exemplary fence lever control device taken in the plane VI—VI of FIG. 4.

As is particularly contemplated within the present invention, an improved fence lever control device is indicated generally at 30 in the drawings of the within disclosure for normally biasing the fence lever 20 and its fence member 22 and nose 29 away from the gate wheel assemblies 23, 24 and 25 and away from the cam wheel 26, respectively, which is operable to bias the fence lever toward the gate wheel assemblies and cam wheel once during each rotation of the dial shaft during only a portion of the shaft revolution in such a manner that if the combination has been dialed correctly during such revolution, the lock can be opened. In the preferred exemplary embodiment, such control device includes a plate 31 mounted at its left hand end in FIGS. 1, 3 and 4 by a pivot pin 32 to the mounting boss 33 formed integrally of lock housing 10. Plate 31 has a laterally extending arm 34 which extends to the right in FIGS. 1, 3 and 4 past the upper free end of the fence lever 20 where an upstanding flange 35 formed integrally of arm 34 mounts a spring 36 secured thereto via aperture 37. Spring 36 is connected at an opposite end to the free end of fence lever 20 by the tab 38 as best seen in FIGS. 2 and 5, there being an aperture, as seen in FIG. 5, in the tab for receiving the spring end. A stop portion 40 is formed in plate 31 in a portion directly upwardly of the mounting at pivot pin 32 to hold the plates counterclockwise revolution to the position illustrated in FIGS. 1 and 3 wherein the control device arm 34 and associated flange 35 mount spring 36 in a position wherein the tension of spring 36, in attempting to pull the lever free end at tab 38 toward flange 35, holds the fence lever 20 in the raised inactive position of FIGS. 1 and 3.

As is further particularly contemplated within the present invention, the fence lever control device of the present invention includes actuator means driven by shaft rotation for shifting the plate 31 and its associated arm 34 (acting as an over center lever) to an over center, active fence lever biasing position wherein spring 36 biases the fence lever 20 toward the gate wheel assemblies 23, 24 and 25 and the fence lever nose 29 toward the cam wheel gate 27 as seen in FIG. 4. Such actuator means in the exemplary embodiment includes an actuator roller 41 rotatably mounted by shaft 42 on the cam wheel 26 so that it revolves with rotation of the dial shaft 19.

The combination for the lock may be predetermined as in the combination locks of said U.S. Pat. No. 4,142,388 and U.S. patent application Ser. No. 289,452 actuator roller 41 engages the lower portion 44 of plate 31 when being rotated in either direction. When roller 41 is in the position of FIG. 3, it to engages the upper follower surface 43 of lower portion 44 in a manner to pivot plate 31 into its over center, active position of FIG. 4 wherein spring 36 biases gate lever 20 into engagement with the gate 27 of cam wheel 26, such event occurring only if the correct combination has been dialed so that the gates 23*a*, 24*a* and 25*a* are aligned with fence 22. Rotations of the dial in clockwise directions during operation of the combination will similarly pivot plate 31 into its over center position.

It should be apparent from the foregoing disclosure, that on rotation of the lock dial shaft 19 in either rotational direction as viewed in FIGS. 3 and 4, the actuator wheel 41 will pivot the fence lever control device plate 31 toward the position of FIG. 4 once on every revolution of the dial shaft, as for example, in the counterclockwise direction indicated by the arrow in FIG. 4 whether the correct combination has been dialed or not. If the correct combination has not been dialed, then the fence 22 will engage the outer periphery of the gate wheel assemblies 23, 24 and 25 holding the fence lever 20 in a raised, intermediate position between the positions illustrated in FIGS. 3 and 4 wherein the lever nose 29 will not enter the cam wheel gate 27. As soon as the actuator roller 41 releases the cam plate 31 by leaving the follower surface 43, as illustrated in FIG. 4, but assuming that the fence 22 is riding on the nongate aligned wheel assemblies 23, 24 and 25, the tension of spring 36 will return the plate 31 and its associated arm 34 in a counterclockwise direction to the inactive position of FIG. 3 with such counterclockwise movement being limited by the stop 40 engaging a side wall of housing 10. The fence lever 20 is thus maintained biased in its inactive or raised position out of engagement with the tumbler wheels and cam wheel thereafter until the dial shaft is rotated in a further full counterclockwise rotation to once again bring the actuator roller 41 into engagement with the follower surface 43.

As is now apparent to those skilled in the art, the fence lever control device of the present invention is very simple in its construction and mode of operation, the plate 31 and spring 36 being so provided as to be mounted at the end of a lock assembly procedure after the tumbler wheel assemblies, fence lever and bolt mechanism have all been assembled into the lock housing. Plate 31 is a simple stamped and formed member and is operated on each full revolution of the lock dial shaft by roller 41 to provide a consistent sound and "feel" to the lock operation unrelated to a correct dialing of the combination and without the need for complex devices or parts for normally holding the fence lever 20 in an inactive position out of engagement with the gate wheel assemblies and cam wheel. Having thus described a preferred exemplary embodiment of the fence lever control device of the present invention, it should be noted by those skilled in the art that various modifications, adaptations and equivalent embodiments may be made within the spirit and scope of the present invention which is defined by the following claims.

I claim:

1. An improved fence lever control device for impeding unauthorized opening of a combination lock through manipulation of the lock components wherein said lock includes a housing, a bolt slidably mounted to the housing, a fence lever moveable about a pivot for operating said bolt relative said housing, a fence member on said lever, a lock dial shaft rotatably mounted to said housing, a plurality of gated wheel assemblies rotatable within said lock housing by rotation of said dial shaft with alignable gates in said assemblies to align with said fence member when said assemblies are oriented in a predetermined manner, a cam wheel on said dial shaft having a cam gate in said wheel, and a nose portion of said fence lever which can enter said cam wheel gate when said assembly gates are aligned to said fence member and said fence lever nose is aligned to said cam gate to thereby move said bolt by operation of said fence lever, said device comprising:

a spring connected at a spring first end to said fence lever;

a plate pivotally mounted to said housing at one end of said plate and having an extension arm integral with said plate, said extension arm acting as an over center lever and being connected to a second end of said spring;

said plate, extension arm and spring being provided so as to normally place said spring second end above a centerline drawn through a point on said fence lever where said first spring end is connected to said fence lever and the center of the pivot for said fence lever to normally bias said fence lever nose portion away from said cam gate;

means for pivoting said plate and extension arm once, during a full revolution of said dial shaft sufficiently to place said spring second end below said center line so as to bias said fence lever by said spring in a direction toward said gated wheel assemblies and cam wheel to allow lock opening operation thereof if the combination of said lock has been entered to place said gated wheel assemblies in a gate aligned relation to said fence member.

2. An improved fence lever control device for a combination lock having a fence lever pivotally mounted to pivot about a pivot axis for operating an associated bolt, a plurality of gate wheels rotatable into a gate aligned relationship relative to the fence lever on rotation of an associated dial shaft in accordance with a predetermined combination of dial rotation, a cam wheel with a cam gate for engaging the fence lever to move it and shift the bolt to an unlocked position when the fence lever engages the cam wheel gate allowed when the gate wheels are in said aligned orientation, said fence lever control device comprising:

a spring connected at one end to said fence lever;

an over center lever connected to a second end of said spring and mounted for shifting movement between a first position wherein said lever positions said spring second end above a centerline drawn through a point on said fence lever where said spring one end is connected to said fence lever and the pivot axis of said fence lever to bias said fence lever away from said wheel assemblies and cam wheel and a second position wherein said lever positions said spring second end below said centerline to bias said fence lever toward said wheel assemblies and cam wheel; and actuator means driven by shaft rotation for shifting said over center lever from its first position to its second position once each shaft rotation.

3. The fence lever control device of claim 2 wherein said device further comprises:

stop means for limiting shifting movement of said over center lever in the direction of shifting movement into said first position.

4. The fence lever control device of claim 2 wherein said fence lever control further comprises:

follower surface means on said over center lever to cause said over center lever to follow said actuator means and said actuator means includes a cam roller mounted to said cam wheel to shift said over center lever by engagement with said follower surface means from said first position to said second position.

5. The fence lever control device of claim 2 wherein said lock includes a housing and wherein said control device further comprises:

a plate pivotally mounted by a pivot pin to said housing at one end thereof, a cam follower surface formed therein for engagement with a cam roller, an extension arm and a spring end mounting flange at a free end of said arm spaced further away from said pivot pin than the spacing therefrom of said follower surface;

a cam roller mounted to said cam wheel; and said over center lever and cam roller being provided for engagement of said follower surface by said roller on each revolution of said cam wheel in a given direction to shift said over center lever toward its second position.

6. In a combination lock having a housing, a lock dial shaft, a bolt operated by a fence lever turnable about a pivot axis and mounting a fence lever nose, a plurality of tumbler wheels mounted on and rotatable by said shaft, a fence lever receiving gate in each of said wheels, a cam wheel and a cam gate for receiving said nose, rotation of said cam wheel when said nose is in said cam gate operating said lever to move the associated bolt, said engagement being allowed only when said wheel gates are aligned to one another and receive said fence, fence lever control and means for normally keeping said nose spaced from said cam wheel and for moving said nose toward said cam wheel in a predetermined manner in response to rotation of said cam wheel whereby premature, lock manipulation type contact between said nose and cam wheel gate are prevented until said time as said tumbler wheel gates are aligned to receive said fence as a prerequisite to nose engagement with said cam wheel, the improvement in said fence lever control means comprising the provision of:

a spring connected at one end to said fence lever;

a plate pivotally mounted to said housing about a fixed pivot at one end of said plate, a cam follower surface formed therein for engagement with a cam roller, an extension arm integral with said plate and being provided for a pivoting movement about said fixed pivot between said fence lever and said lock dial shaft, said extension arm acting as an over center lever and having a spring end mounting flange at a free end thereof, said spring end mounting flange being spaced further away from where said plate is pivotally mounted to said housing than from said follower surface;

said extension arm having its spring end mounting flange connected to a second end of said spring and being mounted for shifting movement between a first position wherein said extension arm positions said spring second end above a centerline drawn through a point where said said spring one end is connected to said fence lever and said pivot axis of said fence lever so as to normally bias said fence lever away from said tumbler wheels and said cam wheel and a second position wherein said extension arm positions said spring second end below said centerline to bias said fence lever toward said tumbler wheels and said cam wheel; and a cam roller mounted to said cam wheel, said extension arm and cam roller being provided for engagement of said follower surface by said roller on each revolution of said cam wheel to shift said extension arm toward its second position.

* * * * *